United States Patent [19]

Ishii et al.

[11] Patent Number: 4,922,673

[45] Date of Patent: May 8, 1990

[54] FIXTURE FOR FLOOR OPENING

[75] Inventors: Kazuo Ishii; Satoshi Yamashita; Hiroyuki Ishige, all of Tokyo, Japan

[73] Assignee: Senoh Kabushiki Kaisha, Tokyo, Japan

[21] Appl. No.: 264,390

[22] Filed: Oct. 31, 1988

[30] Foreign Application Priority Data

Dec. 11, 1987 [JP] Japan ..... 62-188327[U]

[51] Int. Cl.[5] ..... E02D 27/42; B61D 45/00; E04B 5/48

[52] U.S. Cl. ..... 52/221; 248/56; 52/704

[58] Field of Search ..... 248/56, 156; 52/221, 52/298, 704; 273/29 BB, 411; 272/3; 220/331, 333, 3.3, 3.8

[56] References Cited

U.S. PATENT DOCUMENTS 3,575,372 4/1971 Emberson ..... 52/704
4,059,934 11/1977 Hayamizu ..... 52/704
4,520,976 6/1985 Cournoyer et al. ..... 248/56

FOREIGN PATENT DOCUMENTS 884520 4/1943 France ..... 52/704

*Primary Examiner*—James L. Ridgill, Jr.
*Attorney, Agent, or Firm*—Bachman & LaPointe

[57] ABSTRACT

A fixture for supporting a pole in a gymnasium floor comprises a frame on which a pair of hinged lid members are supported. The hinged lid members are each formed with a flat rectangular piece and a piece comprising a semicircular recess and are slidable along tracks so that while the upper surface of the semicircular recessed pieces are flush with the floor the rectangular pieces hang vertically beneath the floor and while the rectangular pieces are flush with the floor the semicircular recessed pieces hang vertically beneath the floor. The semicircular pieces cooperate to define an opening through which the pole can be received and the rectangular pieces cooperative to cover the opening. With this arrangement, no part of the fitting protrudes from the floor so as to pose a hazard.

8 Claims, 5 Drawing Sheets

FIXTURE FOR FLOOR OPENING

BACKGROUND OF THE INVENTION

1. Field of the Invention

The present invention relates to a fixture for a floor opening, particularly to a floor fixture for supporting poles on the floor in order to put up a net used for athletic sports, such as volley ball, tennis, and badminton, and so forth, within a gymnasium.

2. Description of the Background Art

In general, when volley ball or tennis, is played within a gymnasium, poles are provided on the floor for putting up a net. The poles are ordinarily so formed as to be removably inserted vertically to an opening bored in the surface of the floor. The poles are removable so that the floor may be used for multiple purposes. Therefore, when one wishes to play volley ball or tennis within the gymnasium, the poles are first inserted into floor fixtures which are buried at the predetermined positions on the floor.

Conventionally, such fixtures are formed with an outer frame having an opening and a lid for closing the opening, and are often made of metal, such as a brass. The outer frame is buried on the floor, such that a surface of the outer frame is flush with an upper surface of the floor. The above lid is mounted on the outer frame and the surface of the lid is also flush with the surface of the floor when closed. Further, an anchor socket whose axis is perpendicular to the surface of the floor, is buried just under the frame, and is usually firmly fixed in a concrete base. The anchor socket is firmly secured with the outer frame by means of spacers. The anchor socket is often made of metal, such as a solid-drawn steel pipe. Three types of connection between the lid and the outer frame, are well known. In first construction, the lid fits into the opening of the frame, and can simply removed from the opening. In second construction, the lid is pivotably supported by means of a pin on the frame, and is rotatably opened and closed. In third construction, the lid can be slidingly opened along a guide. Such lids project in the vicinity of the frame from the floor when open and thus pose a hazard to the feet of the players. Moreover, when closed the lids tend to open accidentally when jarred by the feet of people on the floor. Moreover, the closed lids tend to be open by bounds of players on the floor.

As may be appreciated from the above, prior art floor fixtures can be dangerous to players during sports.

SUMMARY OF THE INVENTION

Therefore, it is an object of the disclosed invention to provide a floor fixture including a structure for preventing the fixture from opening accidentally.

Another object of the invention is to provide a floor fixture in which the lid assembly is integrally mounted on a base plate and a frame.

In order to accomplish the aforementioned and other objects, a floor fixture according to the present invention, comprises a plate including a pair of elongated holes adjacent to the opposing ends thereof and a center opening for receiving a pole, the plate being fixed on the floor, a frame mating with the upper surface of the plate on the lower surface thereof, a lid including an engaging member for engaging with a bearing surface formed on the lower surface of frame, and the lid formed with a pair of hinge members each of which consists of a lid portion associated with the elongated opening to close the center opening and a pole receiving portion associated with said center opening for receiving the pole.

The frame includes a plurality of projections on an inner peripheral surface thereof to engage with the end surfaces of the lid so that movement of the lid is suppressed by friction between the projections and the end surfaces. The frame further includes the respective recesses close to the plurality of projections so that the projections are elastically deformed outwardly in the projecting directions thereof.

The frame preferably includes the respective fasteners to engage with a plurality of notches formed at both ends of the pair of elongated holes in order to firmly fix the frame on the plate.

Preferably, the plate, the frame, and the lid are symmetrical.

The center opening includes a pair of opposing recesses parallel to the pair of elongated holes through which the center opening is associated with the pole receiving portion.

Furthermore, the frame includes a plurality of projections on its lower surface to engage with a plurality of holes on the upper surface of plate, thereby preventing relative movement of the frame to the plate.

According to another aspect of the invention, a structure comprises a plate including a pair of first openings adjacent to the opposing ends thereof and a second opening in the substantially center thereof, a frame including an engaging member for engaging with the mating surface of frame;-the lid being formed with a pair of hinge members, each of members consisting of a first portion which is associated with either of the pair of first openings to close the second opening and a second portion which includes a cut-out and associated with the second opening to define an opening.

BRIEF DESCRIPTION OF THE DRAWINGS

The foregoing and other features and advantages of the disclosed invention will be apparent from the detailed description contained hereinbelow and taken in conjunction with the accompanying drawings of the preferred embodiment of the invention, which should not be taken to limit the invention but are for explanation and understanding only.

In the drawings.

DESCRIPTION OF THE PREFERRED EMBODIMENT

Figure 1:
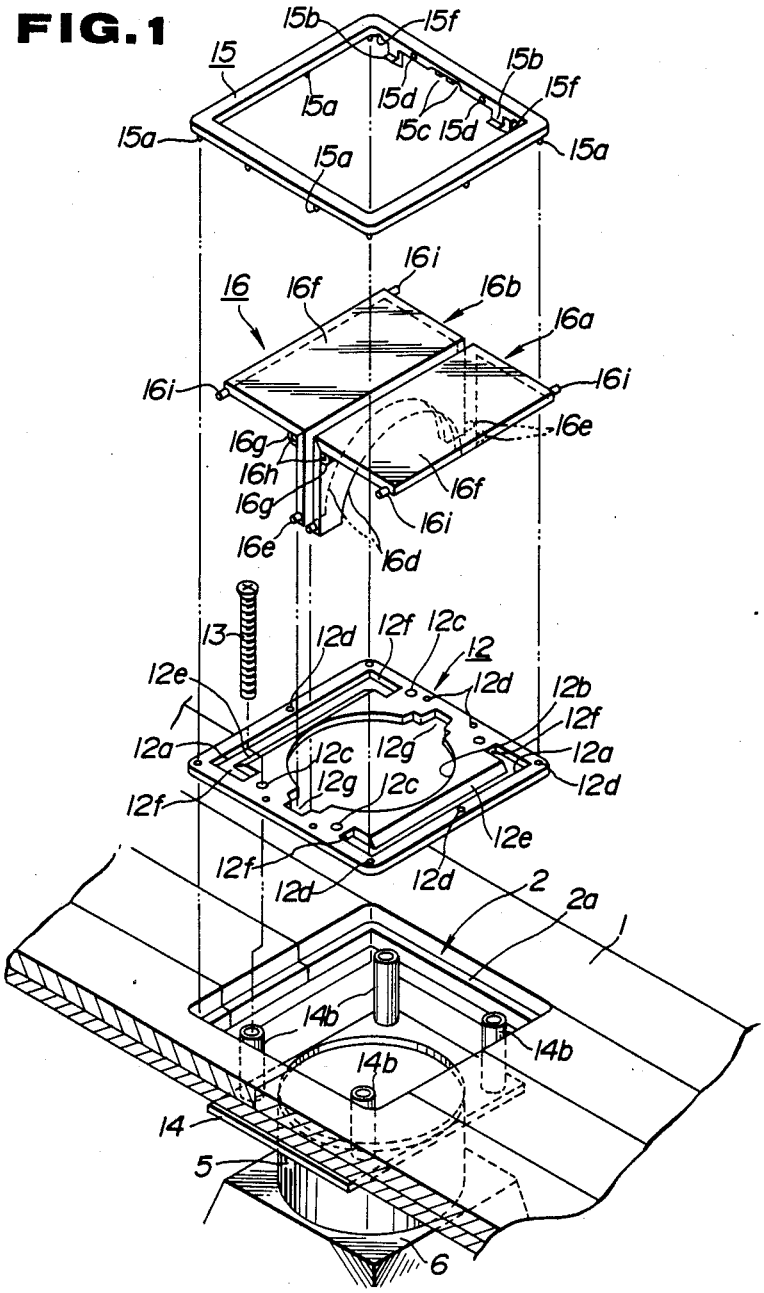
FIG. 1 is an exploded perspective view illustrating the preferred embodiment of a floor fixture according to the invention.

Referring now to the drawings, as shown in FIG. 1, a substantially rectangular floor opening 2 is bored in a floor 1. The rectangular floor opening 2 includes a plate support 2a formed on its inner peripheral surface for supporting a substantially rectangular base plate 12 thereon.

The base plate 12 has a pair of bracket shaped openings 12a near the opposite ends thereof. The basic plate 12 has also a substantially circular opening 12b bored in its center for receiving a pole 11. Four holes 12c are bored near the inner peripheral surface of the circular opening 12b. A plurality of holes 12d are bored adjacent to the outer peripheral surface of the base plate 12. Two taper surfaces 12e are formed on the inner wall of the bracket shaped openings 12a and near the inner peripheral surface of the circular opening 12b. Reference numeral 12f denotes the four recesses of the bracket shaped opening 12a. Two notches 12g are formed on the inner wall of the circular opening 12b in parallel to the bracket shaped openings 12a and are located diametrically opposed across the center axis of the circular opening 12b.

A cylindrical anchor socket 5 is disposed under the rectangular opening 2 for receiving the end of the pole 11. The anchor socket 5 is firmly fixed in a concrete base 6. Four cylindrical spacers 14b are detachably disposed on four corners of a rectangular holder plate 14 which is firmly fixed on the upper surface of the anchor socket 5 by welding. As clearly seen in FIG. 1, the base plate 12 is secured to the holder plate 14 through the four spacer 14b by means of four screws 13 which are screwed into four threaded portions 14a (shown in FIG. 6) through the four holes 12c and four spacers 14b. As a result, the outer peripheral section of the base plate 12 is firmly supported by the plate support 2a.

Figure 2:
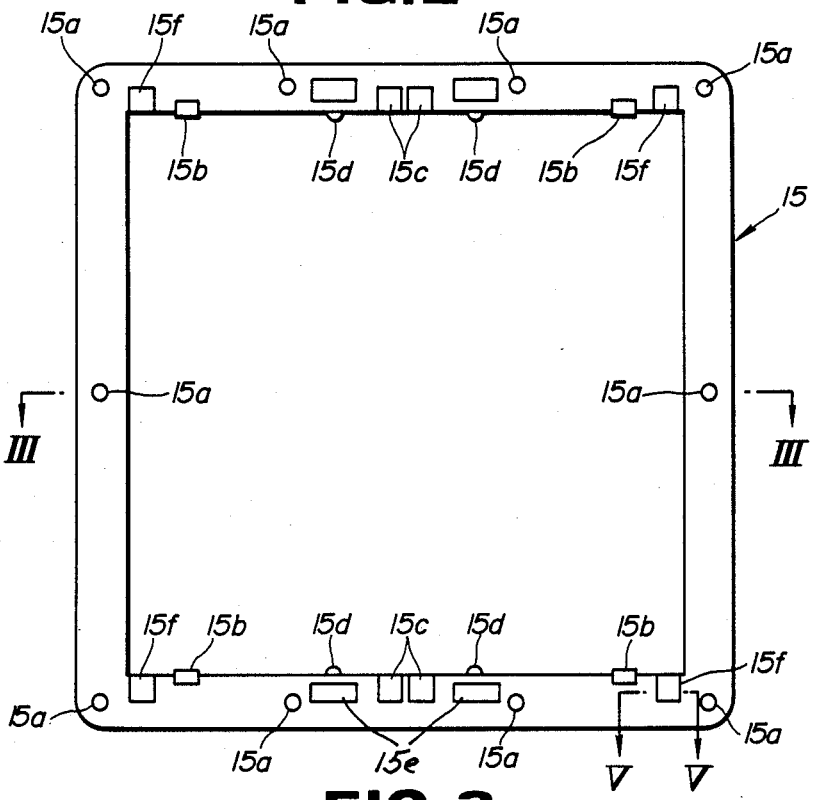
FIG. 2 is a plan view showing the bottom face of a frame of the preferred embodiment.
Figure 3:
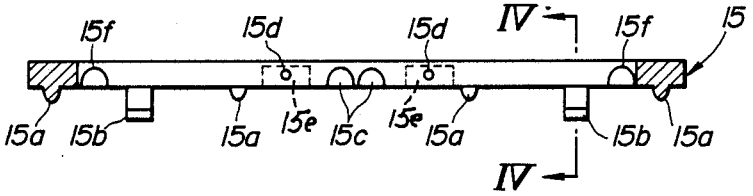
FIG. 3 is a cross sectional view taken on line III—III of FIG. 2.
Figure 4:
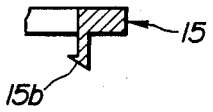
FIG. 4 is a cross sectional view taken on line IV—IV of FIG. 2.
Figure 5:
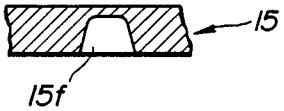
FIG. 5 is a cross sectional view taken on line V—V of FIG. 2.
Figure 6:
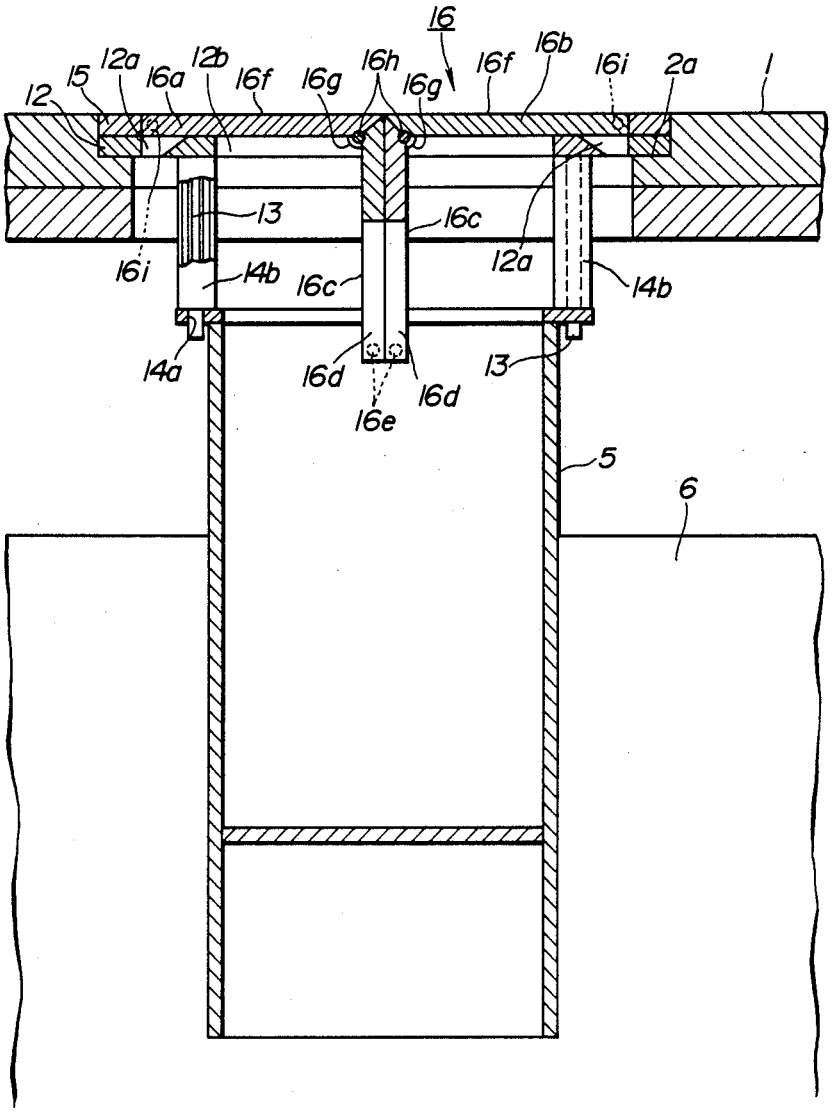
FIG. 6 is a longitudinal sectional view illustrating the lid assembly of the invention in the closed position.

As shown in FIGS. 1 to 5, reference numeral 15 denotes a substantially rectangular frame 15 which may be mounted on the upper surface of the base plate 12. The profile of the outer peripheral surface of the rectangular frame 15 essentially matches that of the base plate 12 as best shown in FIG. 6. The frame 15 has a plurality of hemispherical projection 15a each of which is inserted into the plurality of holes 12d, respectively, for restraining the horizontal movement of the frame 15 relative to the base plate 12. The frame also includes four L-shaped fasteners 15b projecting near its four corners for engaging with the four recesses 12f so that the tab portions of the L-shaped fasteners tightly engage with the bottom surface of the base plate 12. Moreover, the frame 15 has two pairs of bearing surfaces 15c opposing the two notches 12g of the circular opening 12b, respectively, and further has two pairs of bearing surfaces 15f in the four corners thereof. As best seen in FIG. 2, the frame 15 includes two pairs of hemispherical projections 15d and two pairs of recesses 15e formed behind the projections 15d in such a manner that the projections 15d may be elastically deformed outwardly in the horizontal direction of the frame 15.

Although the bottom surface of the frame 15 mates with the upper surface of the base plate 12, the frame 15 does not cover the pair of bracket shaped opening 12a, the pair of notches 12g and the four recesses 12f.

Figure 7:
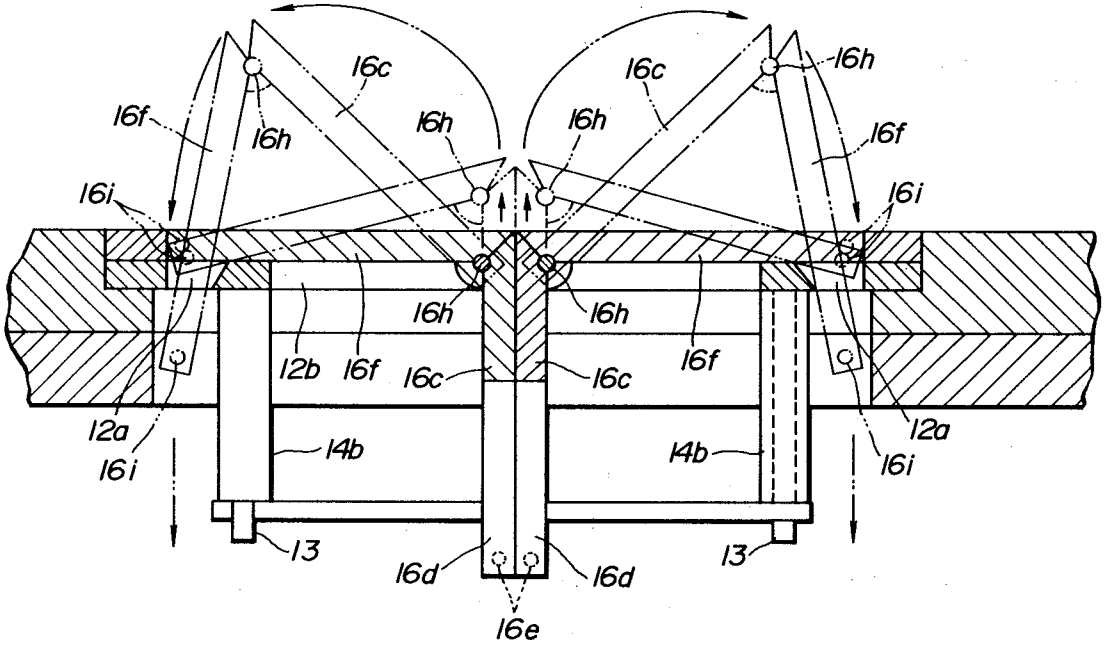
FIG. 7 is an explanatory view illustrating the opening motion of the lid assembly according to the invention.

As shown in FIG. 1, reference numeral 16 denotes a lid assembly which is movably retained between the basic plate 12 and the frame 15 by means of two pair of pins 16e and 16i. The lid assembly 16 comprises a pair of lid members 16a and 16b. The respective lid members 16a and 16b are a first member 16c having a semicircular cut-out 16d and a second member 16f serving as a lid for closing the circular opening 12b. As shown in FIGS. 6 and 7, the first and second members are pivotably connected by means of a hinge 16g such that the angle between the first and second members may become an acute angle. Each of the adjacent ends of first and second members 16c and 16f is formed with a 45° taper surface, as best seen in FIG. 7, and pivot about a hinge pin 16h.

Figure 8:
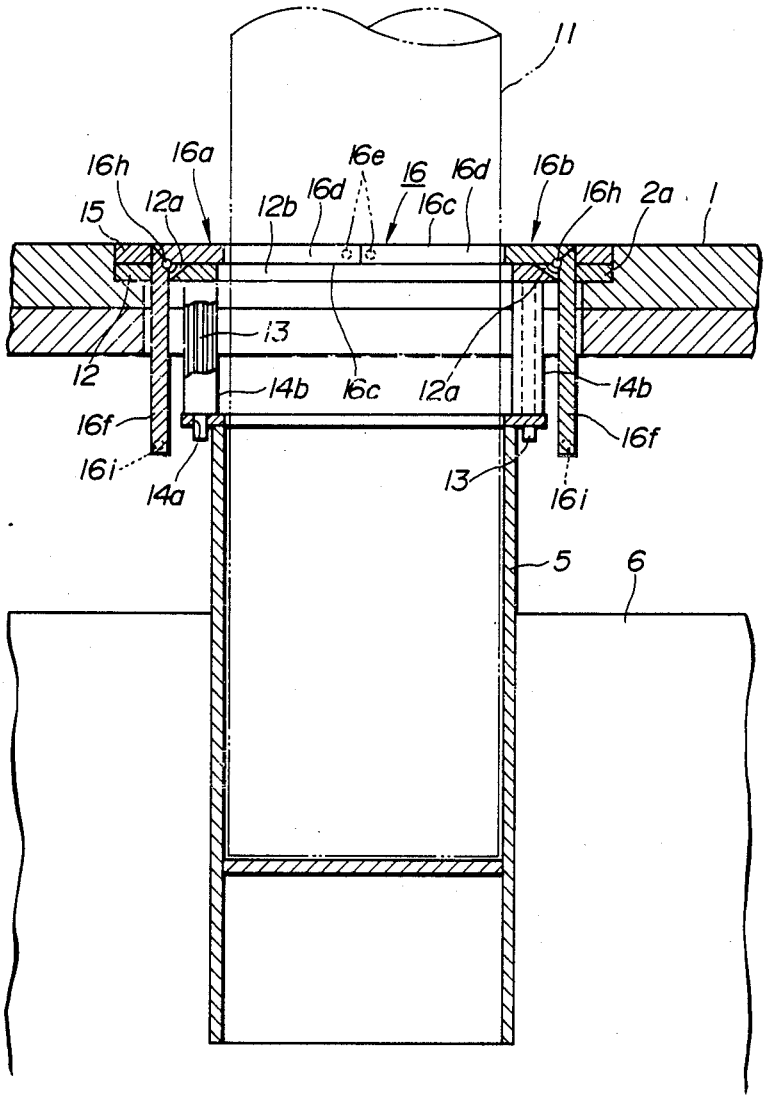
FIG. 8 is a longitudinal sectional view illustrating the lid assembly of the invention in the open position.

As shown in FIG. 8, while the pair of first members 16c are laying horizontally on the base plate 12, the two pairs of pins 16e engage with the two pairs of bearing surfaces 15c, and also one large circle is formed, by the two semicircular cut-outs 16d of the first members 16c, whose diameter is equal to or larger than that of the inner periphery of the anchor socket 5. Conversely, as shown in FIG. 6, while the pair of second members 16f are laying horizontally on the base plate 12, the two pairs of pins 16i engage with the two pair of recesses 15f.

The base plate 12, frame 15, and lid assembly 16 may be made of any of various materials, such as metals, synthetic resins, such as for example, engineering plastics, or so forth.

While the frame 15 and the lid assembly 16 are mounted on the base plate 12 such that the four L-shaped fasteners 15b are pushed into the four recesses 12f and the pins of the lid assembly 15 move within the predetermined range defined between the frame 15 and the basic plate 12, if the level of the upper surfaces are different from that of the floor 1, the level can be easily adjusted by the spacers 14b after removing the four male screws.

As will appreciated from the above, although the floor fixture of the preferred embodiment according to the present invention is described as including a circular opening for the cylindrical pole, it is not intended to limit the invention of floor fixture thereto. For instance, the floor fixture of the invention comprises a rectangular opening for a rectangular pole.

The movement of the lid assembly 16 of the preferred embodiment of the invention will be more clearly understood from the following detailed description:

As shown in FIG. 6, when the pair of second members 16f of the lid assembly 16 are horizontally arranged, the pair of first members 16c hang vertically and the adjacent surfaces of first members 16c abut each other. In this condition, the pair of first members 16c function as weights for preventing the second members 16f from bouncing open when the floor 1 is jarred. Further, the two pairs of hemispherical projections 15d of the frame 15 function as fasteners for fastening the ends of the second members 16f. As a result, the lid assembly 16 is effectively kept in the fully closed position.

As shown in FIG. 7, while the pole 11 is supported in the floor 1 for sports using a net, such as volley ball, tennis, or so forth, the lid assembly 16 is moved from the fully closed position to the fully open position. This movement of the lid assembly 16, shown in an intermediate position in phantom lines, is performed as follows:

First, the ends of the pair of second members 16f adjacent to the elongated bracket shaped openings 12a are pushed into the bracket shaped openings 12a, and at the same time, the two pairs of pins 16i separate from the two pairs of bearing surfaces 15f. Thus, the pair of second members 16f are lowered into the bracket shaped openings as the pair of first members 16c is moved from the vertical position to the horizontal position.

In this way, the lid assembly 16 is positioned in the full open position in which the free ends of the pair of first members 16c abut each other and their hemispherical openings form one large circle for receiving the end of the pole as shown in FIG. 8. In this fully open position of the lid assembly 16, the two pairs of pins 16e of the first members 16c mate with the two pairs of the bearing surfaces 15c and in this condition, the pair of second members 16f function as weights for preventing the first members 16c from bouncing up when the floor 1 is jarred. Furthermore, the two pairs of semicircular projections 15d of the frame 15 function to engage the sides of the first members 16c so as to restrain them.

Next, when the lid assembly 16 is moved from the full open position as shown in FIG. 8 to the full closed position as shown in FIG. 6, the abutting ends of the first members 16c are pushed downward. After this, the movement of the lid assembly 16 is the reverse of that set forth above.

Although the preferred embodiment of the invention has been disclosed in terms of a floor fixture used for supporting poles for athletic sports, such as tennis, volley ball, within gymnasiums, it is not intended to limit the scope of the invention to such floor fixture. for instance, the structure of the floor fixture may be applicable as a door to a bin for storing foods under the floor of a kitchen. The invention may be embodied in other specific forms without departing from the spirit or essential characteristics thereof. Therefore, the invention should be understood in all respects as defined by the appended claims rather than by the foregoing description and all modifications which come within the meaning and range of equivalency of the claims are therefore intended to be embraced therein.

What is claimed is:

1. A floor fixture comprising:

a plate having an upper surface and opposed ends and including a pair of elongated holes adjacent to the opposing ends thereof and a center opening for receiving a pole, said plate being fixed on a floor;

a frame mating with and attached to the upper surface of said plate and defining therewith a mating surface, said frame including an opening exposing said elongated holes and center opening;

a lid including a pair of hinge members each of which consists of a lid portion associated with either of said elongated holes to close the opening of said frame, a pole receiving portion associated with said center opening for receiving said pole, said pole receiving portion having a free end and a hinge pin through which said lid portion and said pole receiving portion are hingedly connected with each other, said lid portion having a free end and including a first pivotable portion in the vicinity of the free end thereof, parallel to the axis of said hinge pin, said pole receiving portion including a second pivotable portion provided in the vicinity of the free end thereof, parallel to the axis of said hinge pin;

said frame including first and second bearing surfaces being capable of pivotally supporting said first and second pivotable portions respectively, said bearing surfaces being formed on the mating surface of said frame to the upper surface of said plate; and said lid being movable to a first set position wherein said first pivotable portions are supported by said first bearing surfaces and said lid portions are flush with the floor to cooperatingly close the opening of said frame while said pole receiving portions are disposed beneath the frame and a second set position wherein said second pivotable portions are supported by said second bearing surfaces and said pole receiving portions are flush with the floor to cooperatingly define an opening for receiving the pole.

2. A floor fixture as set forth in claim 1, wherein said frame includes the respective fasteners to engage with a plurality of notches formed at both ends of said pair of elongated holes.

3. A floor fixture as set forth in claim 1, wherein said plate, said frame, and said lid are symmetrical.

4. A floor fixture as set forth in claim 1, wherein said center opening includes a pair of opposing recesses parallel to said pair of elongated holes.

5. A floor fixture as set forth in claim 1, wherein said frame includes a plurality of projections on its lower surface to engage with a plurality of holes on said upper surface of plate, thereby preventing relative movement of said frame to said plate.

6. A floor fixture as set forth in claim 1, wherein when said lid is set to the first or second set positions, each of said lid portions and said pole receiving portions which are connected to each other are perpendicularly arranged with respect to each other.

7. A floor fixture as set forth in claim 1, wherein said frame includes a plurality of projections on an inner peripheral surface thereof, gently catching the lid, to suppress movement of said lid.

8. A floor fixture as set forth in claim 7, wherein said frame includes recesses associated with said plurality of projections to allow elastic deformation of said projections in a direction opposite the projecting directions thereof.

* * * * *